US009976705B2

(12) United States Patent
Petku et al.

(10) Patent No.: US 9,976,705 B2
(45) Date of Patent: May 22, 2018

(54) LIGHT ENGINE FOR AC AND DC DRIVER ARCHITECTURES FOR LED LAMPS

(71) Applicant: eLUMIGEN LLC, Auburn Hills, MI (US)

(72) Inventors: Brian Petku, Clarkston, MI (US); Mahendra Dassanayake, Bloomfield Hills, MI (US); Gennaro Fedele, West Bloomfield, MI (US)

(73) Assignee: eLumigen, LLC, Auburn Hills, MI (US)

( * ) Notice: Subject to any disclaimer, the term of this patent is extended or adjusted under 35 U.S.C. 154(b) by 0 days. days.

(21) Appl. No.: 15/602,626

(22) Filed: May 23, 2017

(65) Prior Publication Data

US 2017/0343165 A1 Nov. 30, 2017

Related U.S. Application Data

(60) Provisional application No. 62/341,857, filed on May 26, 2016.

(51) Int. Cl.
*F21K 9/238* (2016.01)
*F21V 23/06* (2006.01)
(Continued)

(52) U.S. Cl.
CPC ..... *F21K 9/238* (2016.08); *F21K 9/232* (2016.08); *F21K 9/235* (2016.08); *F21V 3/02* (2013.01);
(Continued)

(58) Field of Classification Search
CPC ..... F21K 9/238; F21K 9/232; F21K 9/235; F21V 23/89; F21V 3/02; F21V 7/22; F21V 23/06
See application file for complete search history.

(56) References Cited

U.S. PATENT DOCUMENTS 8,142,227 B1 * 3/2012 Kuo ..... H01J 5/62 439/611
2006/0226795 A1 10/2006 Walter
(Continued)

FOREIGN PATENT DOCUMENTS

EP 2718616 A1 4/2014

OTHER PUBLICATIONS

Communication in corresponding PCT application PCT/US2017/034498 enclosing Partial International Search Report, dated Jul. 20, 2017, 10 pgs.

*Primary Examiner* — Anne Hines
(74) *Attorney, Agent, or Firm* — Harness, Dickey & Pierce, PLC

(57) ABSTRACT

A light engine includes a first plurality of diodes coupled in series. The first plurality of diodes includes a first anode end and a first cathode end. A second plurality of diodes is coupled in series. The second plurality of diodes includes a second anode end and a second cathode end. A first terminal is electrically coupled to the first cathode end and said second anode end to form a first node. The second terminal is coupled to said first anode end. A third plurality of diodes is coupled in series. The second plurality of diodes includes a third anode end and a third cathode end. The third terminal is coupled to the third cathode end. A fourth terminal is electrically coupled to the second cathode end and the third anode end to form a first node.

10 Claims, 14 Drawing Sheets

(51) Int. Cl.

| | |
|---|---|
| ***F21K 9/235*** | (2016.01) |
| ***F21K 9/232*** | (2016.01) |
| ***F21V 3/02*** | (2006.01) |
| ***F21V 7/22*** | (2018.01) |
| ***F21V 29/89*** | (2015.01) |
| *F21Y 105/18* | (2016.01) |
| *F21Y 115/10* | (2016.01) |

(52) U.S. Cl.
CPC ..... *F21V 7/22* (2013.01); *F21V 23/06* (2013.01); *F21V 29/89* (2015.01); *F21Y 2105/18* (2016.08); *F21Y 2115/10* (2016.08)

(56) References Cited

U.S. PATENT DOCUMENTS

2011/0028015 A1* 2/2011 Mostoller ..... H01J 5/50
439/280
2011/0115414 A1 5/2011 Ku
2012/0217861 A1* 8/2012 Soni ..... F21V 19/0025
313/46
2013/0257278 A1* 10/2013 DeVore ..... H01J 5/54
315/113
2014/0292213 A1 10/2014 Yoon

* cited by examiner

LIGHT ENGINE FOR AC AND DC DRIVER ARCHITECTURES FOR LED LAMPS

CROSS-REFERENCE TO RELATED APPLICATIONS

This application claims the benefit and priority of U.S. Provisional Application No. 62/341,857 filed on May 26, 2016. The entire disclosure of the above application is incorporated herein by reference.

INCORPORATION BY REFERENCE

This application incorporates U.S. Pat. No. 8,723,424 issued on May 13, 2014, U.S. patent application Ser. No. 14/821,864 filed Aug. 10, 2015 and U.S. patent application Ser. No. 14/878,249 filed Oct. 8, 2015, the disclosures of which are incorporated herein by reference.

TECHNICAL FIELD

The present disclosure relates generally to a lighting assembly and, more specifically, an apparatus for connecting a light engine with power connections thereto.

BACKGROUND

This section provides background information related to the present disclosure which is not necessarily prior art.

A light bulb has a lamp base and housing. The lamp base is used to electrically connect the light bulb to the light socket. Some lamp bases screw into the light socket, whereas others may be pushed into the light socket or connected in a different way. The housing contains many different parts that are all used together to illuminate desired areas. The housing also has an outward facing portion, the outward facing portion being clear or shaded depending on the desired light output, which exposes the light on the desired area. Some of the parts within the housing include but are not limited to power circuitry, wires, mechanical positioning devices and light sources. In order to maintain the functionality of the light, the circuit board (or the electrical conductors therein) is electrically connected to the base. This connection is made, for example, by soldering a wire to connect the electrical lamp base to the circuit board. The circuit board is then be secured within the lamp base so the circuit board cannot shift its position within the light while it is being moved. Light bulbs have increasing become cost competitive. To reduce costs, design configurations are desired for more efficient methods of assembly.

SUMMARY

This section provides a general summary of the disclosure, and is not a comprehensive disclosure of its full scope or all of its features. In order to lower the manufacture time and ultimate cost, configurations within the light bulb are set forth to increase the efficiency and productivity of the manufacturing process.

In one aspect of the disclosure, a light engine includes a first plurality of diodes coupled in series. The first plurality of diodes includes a first anode end and a first cathode end. A second plurality of diodes is coupled in series. The second plurality of diodes includes a second anode end and a second cathode end. A first terminal is electrically coupled to the first cathode end and said second anode end to form a first node. The second terminal is coupled to said first anode end.

A third plurality of diodes is coupled in series. The second plurality of diodes includes a third anode end and a third cathode end. The third terminal is coupled to the third cathode end. A fourth terminal is electrically coupled to the second cathode end and the third anode end to form a first node.

In another aspect of the disclosure, a light assembly comprises a light engine circuit board comprising a metal core. The light engine circuit board comprising a first side comprising a first conductor and a light engine electrically coupled to the first conductor. The light engine circuit board comprises a second conductor and a driver circuit coupled to the second conductor. A connector is disposed though the light engine circuit board. The connector comprises a plurality of terminals. A first terminal of the plurality of terminals electrically coupled to a first conductor on the first side of the light engine circuit board and a second terminal of the plurality of terminals electrically coupled to a second conductor on a second side of the light engine circuit board. A second circuit board comprising a pin extending into the connector and electrically coupling the first terminal and the second terminal.

Further areas of applicability will become apparent from the description provided herein. The description and specific examples in this summary are intended for purposes of illustration only and are not intended to limit the scope of the present disclosure.

DRAWINGS

DETAILED DESCRIPTION

Figure 1:
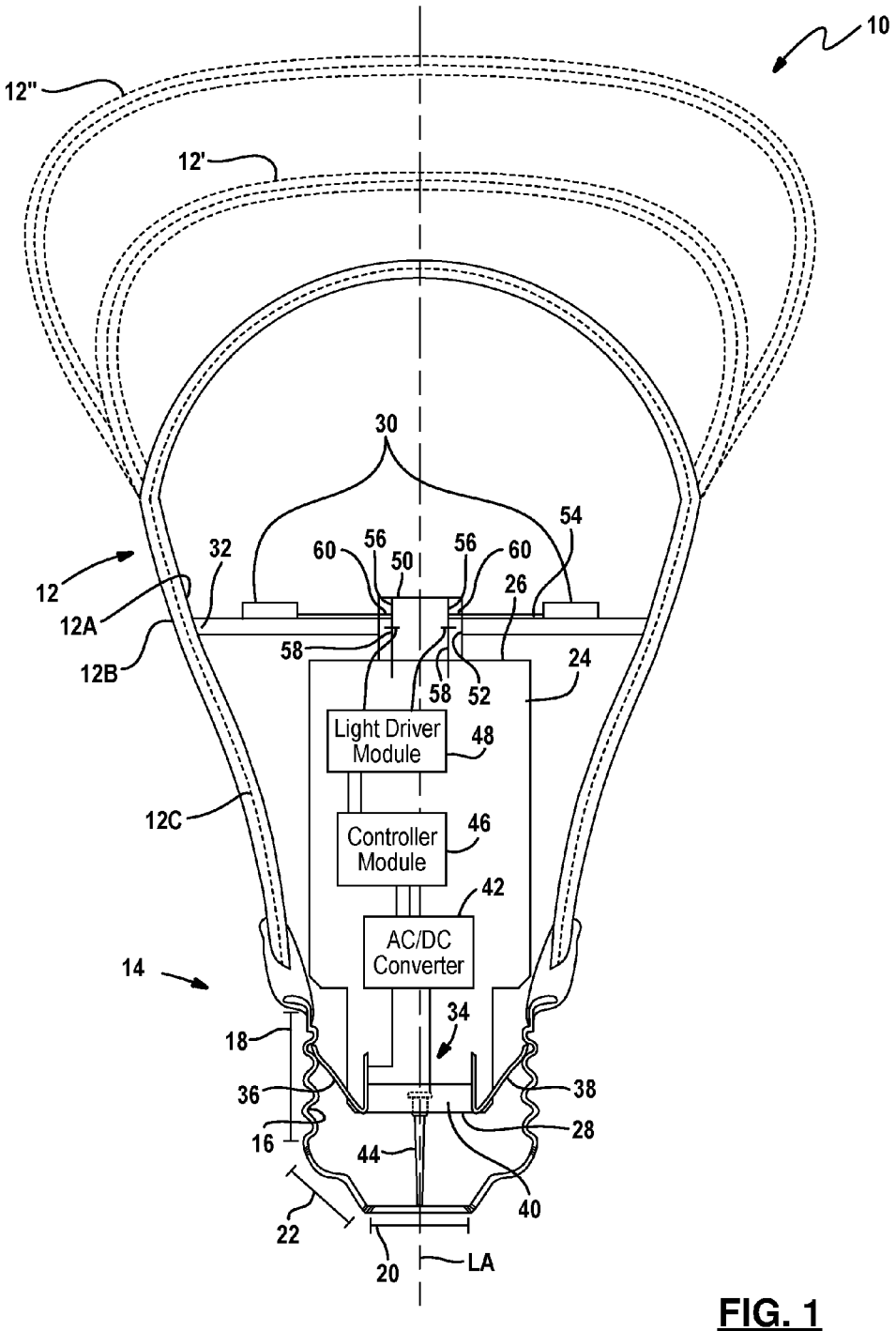
FIG. 1 is a cross-sectional view of a first assembly of a light according to the present disclosure.

The present disclosure will now be described fully herein with references to the accompanying figures, in which the various examples are shown. This disclosure may, however, be embodied in many different forms and should not be limited to the present disclosure, application or uses. For purpose of clarity, the same reference numbers will be used in the drawings to identify similar elements.

It should be noted that in the following figures, various components may be used interchangeably. For example, the circuit board illustrates one of many possible implementations of a light source circuit. This particular circuit board layout is for example purposes only and is not meant to limit the disclosure to this particular implementation. Further, although light emitting diodes (LEDs) are described, various other light sources may be used such as lasers and organic light emitting diodes.

Referring now to FIG. 1, a cross-sectional view of the assembly 10 is shown. This assembly includes a lamp base 14 and a housing portion 12. The lamp base 14 is used to connect the light bulb to the light socket and provide electrical energy to the light bulb. The housing portion 12 may come in different shapes and sizes, depending on the type of lighting conditions desired, the surface area being lit, and the shading or color of the light to be emitted from the light bulb. Alternative shapes for housing portions 12' and 12" are also illustrated in hidden lines. The housing portion 12 may act as a cover to transmit light therethrough. The light assembly has a longitudinal axis LA that extends through the middle of the housing portion 12 and the base 14.

In one example, the assembly 10 has a circuit board 24 and a contact interface 34. The circuit board 24 may have a first end 26 and a second end 28. This circuit board 24 is used to drive light sources 30 from power supplied to the electrical lamp base 14. The light sources 30 may be mounted on a circuit board 32. The light sources 30 may be in electrical communication with the lamp base 14 through the circuit board 24 and the circuit board 32 positioned within the housing 12. The light sources 30 may be LED light sources, lasers, or any light-emitting device known in the art.

Various ways for connecting the circuit board 24 to electrical power through the base may be used. In this assembly 10, the circuit board 24 is connected to the base 14 through a contact interface 34. The contact interface 34 includes a first electrically conductive biasing portion 36 and a second electrically conductive biasing portion 38. These two separate biasing portions engage an interior threaded portion 16 of the lamp base 14 on opposite sides of the contact interface and suspend the circuit board 24 within the housing portion of the light assembly.

A force that is produced from the contact between the interior threaded portion 16 and the first biasing portion 36 counteracts a force that is produced between the second biasing portion 38 and the interior threaded portion 16 of the base 14 by means of a bridge portion 40 that connects the first biasing portion 36 to the second biasing portion 38.

The bridge portion 40 may be electrically conductive in order to allow the first biasing portion 36 to be in electrical communication with the second biasing portion 38. This bridge portion 40 may also be composed of a non-conductive material in order to insulate the first biasing portion 36 from the second biasing portion 38. This would be in circumstances where the electrical signal from the first biasing portion is different from the electrical signal of the second biasing portion and the points of contact of the respective biasing portions within the lamp base 14 are insulated from one another.

The bridge portion 40 is located on a bridge plane created between the first biasing portion 36 and the second biasing portion 38. This bridge plane runs parallel to a primary plane created between the first end 26 and second end 28 of the circuit board.

Depending on the desired mode of operation the circuit board 24 may include various electronic circuits or, in some instances, no electronic circuits at all. In this example, the contact interface 34 may facilitate a connection between the lamp base 14 and an AC/DC converter 42, which would also have an input from a prong or electrical contact 44 extending from the circuit board 24 to the base 14. The conductive portion 20 where electrical contact 44 contacts the base 14 is insulated from the parts of the lamp base 14 which are engaged by the first biasing portion 36 and second biasing portion 38 by insulating portion 22. The bridge portion 40 is suspended above the electrical contact 44. The AC/DC converter 42 may be in communication with a controller module 46. This controller module 46 may be used for many purposes, including but not limited to dimming the lights, turning the lights on and off, strobing the lights, setting a timer, etc. This controller module 46 may be in communication with a light driving module 48 which would be in direct communication with the light sources 30.

Figure 2A:
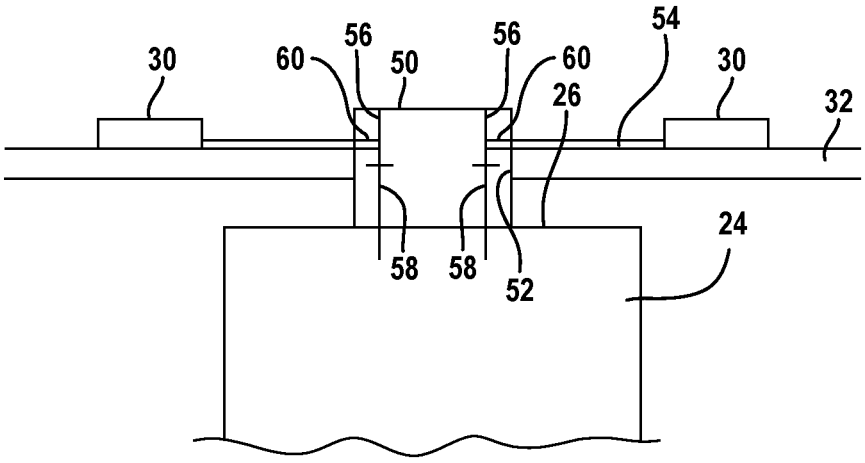
FIG. 2A is an enlarged cross-sectional view of the connector of FIG. 1.

Referring now to FIGS. 1 and 2A, the circuit board 24 and the circuit board 32 are electrically connected through a connector 50. The connector 50 may be positioned within an opening 52 through the circuit board 32. The circuit board 32 may include circuit traces or conductors 54 on a surface thereon. The conductors may also be disposed in one or more layers of a multi-layer circuit board. The connector 50 may include terminals or conductors 56 that are in electrical contact with the conductors 54. The circuit board 24 may also include terminals or conductors 58 that are in electrical communication with the conductors 56 and ultimately the terminals or conductors 54. The words "terminal" and "conductor" may be used interchangeably. The shape and the interfaces of the conductors 56 and 58 may vary. The conductors 56 may, for example, be female sockets while the conductors 58 may be pins, or vice versa. Of course, other kinds of electrical and mechanical couplings may be used for the conductors 56 and 58. Extensions 60 may be used to couple the terminal or the conductors 56 to the circuit board conductors 54. Soldering or other means of mechanical electrical connections may be used. For assembly purposes, the conductors 58 may easily connect with the conductors 56 when the circuit board 32 and circuit board 24 are brought together during manufacturing. The manufacturing process may be an automated process.

Figure 2B:
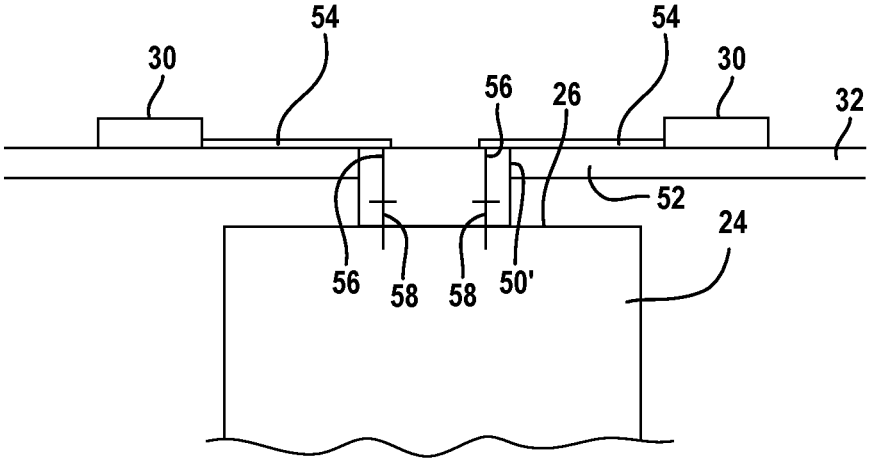
FIG. 2B is an enlarged cross-sectional view of alternate configuration for connector.

Referring now to FIG. 2B, an alternate connector 50' may be disposed on the lower surface of the circuit board 32 rather than through the circuit board as show in FIGS. 1 and 2A. The connector 50' may have the conductors 56 coupled through the circuit board 32 and to the conductors 54. For simplicity, two conductors or terminals within the connector 50' are illustrated. However, a greater number of terminals or conductors may be used in this example and the example of FIGS. 1 and 2A.

Figure 3A:
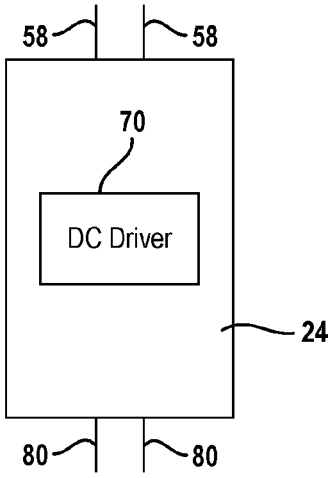
FIGS. 3A-3E are side views of circuit boards comprising using different circuitry.
Figure 3B:
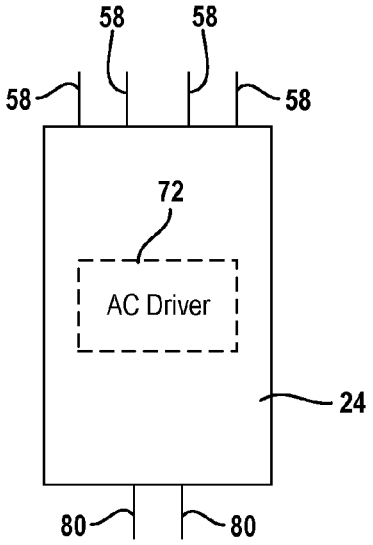

Referring now to FIGS. 3A-3B as mentioned above, the types of circuitry included on the circuit board 24 may vary. Likewise, the number of conductors 58 that extend from the circuit board 24 to electrically connect to the circuit board 32 may also vary.

In FIG. 3A, a DC driver 70 is used for driving the light sources 30 of FIG. 1. The DC driver 70 may provide a DC electrical voltage at the conductors 58.

In FIG. 3B, an AC driver 72 is used. The AC driver 72 may provide alternating current to the conductors 58. In this example, four conductors 58 may extend from the circuit board 24 to couple to various strings of the light sources as will be described in further detail below. The number of conductors 58 may, for example, be one greater than the number of strings of light sources 30.

Figure 3C:
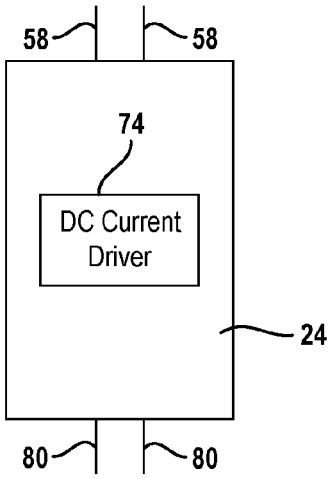

In FIG. 3C, a DC current driver 74 may be disposed on the circuit board 24. The DC current 74 may provide a DC current to the light sources 30 through the conductors 58.

Figure 3D:
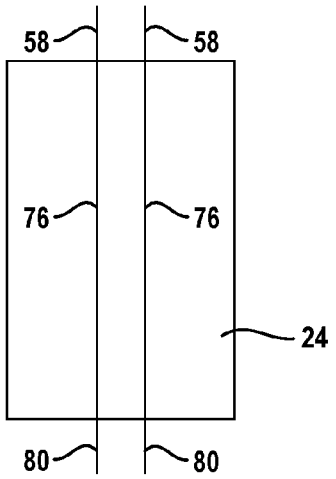

In FIG. 3D, conductors 76 may provide a direct pass-through from the end conductor 80 of the circuit board 24 to the conductors 58. That is, the end conductors 80 may be directly coupled to the conductors 58 using the pass-through conductors 76. This may be useful if no regulation or controlling is desired with a daylight assembly. The conductors 76 may provide direct current or alternating current to the conductors 58.

Each of the circuit boards 24 illustrated in FIGS. 3A-3D may include the conductors 80. The conductors may represent the first biasing portion 36, or the second portion 38 and the electrical contact 44.

Figure 3E:
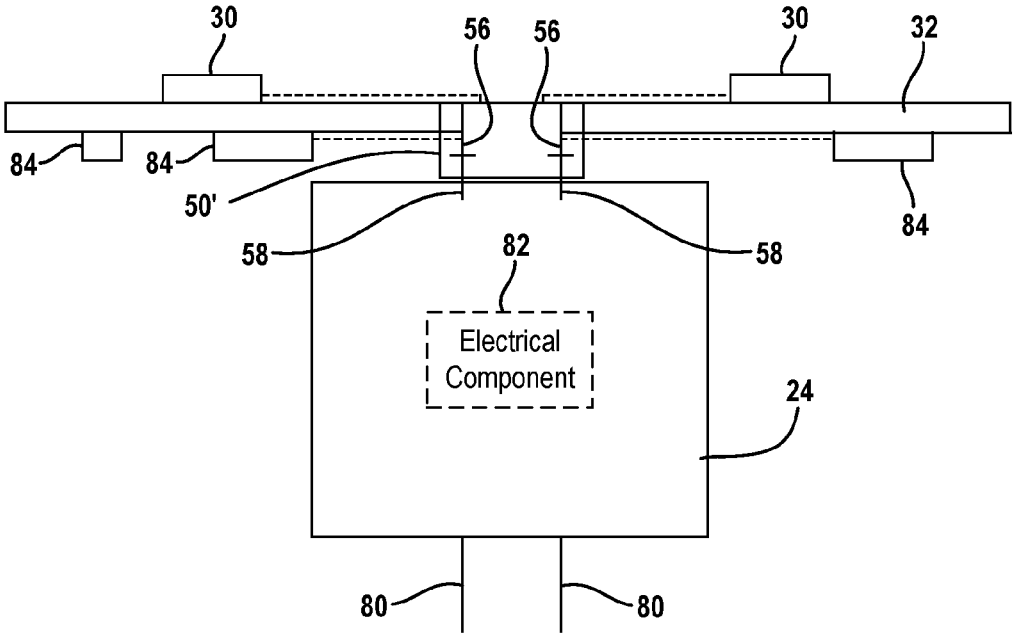

Referring now to FIG. 3E, the circuit board 24 may include one type of electrical component 82 or no electrical components as illustrated in FIG. 3D. The electrical component 82 may include the DC driver, AC driver or the DC current driver or combinations thereof. The electrical component 82 may be in communication with the conductor 58 and to a connector 50'. The connector 50' may be replaced by the connector 50 illustrated in FIG. 1. In this example, the circuit board 32 may include electrical components 84 disposed on a bottom surface thereof. The components 84 may be surface mounted or affixed in other ways. The electrical components 84 may include the DC driver and DC current driver illustrated above. The conductors 56 may be an electrical communication with the electrical components 84 and the light sources 30.

Figure 4A:
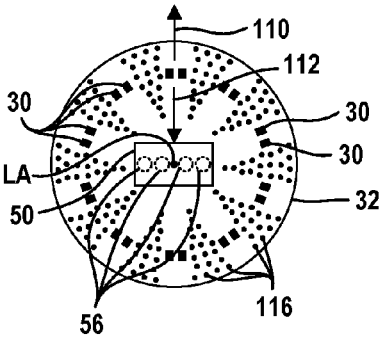
FIG. 4A is a top view of a circuit board according to the present disclosure.

Referring now to FIG. 4A, one example of a circuit board 30 is illustrated. The circuit board 30 includes the plurality of light sources 30 thereon. Each circuit board 30 of FIGS. 4A-4E have a connector (or connector 50' disposed therethrough or thereon. The connectors 50 may have various numbers of terminals or conductors 56 exposed above the circuit board 30, below circuit board 30, or both. The circuit board 30 includes a radial outward thermal path 110 and a radially inward thermal path 112.

Various numbers of electrical components for driving the light sources may be incorporated onto the circuit board 30. Thermal vias 116 may be provided throughout the circuit board 30 to allow a thermal path to the heat sink. As is illustrated, the thermal vias 116 are generally laid out in a triangular or pie-piece arrangement but do not interfere with the thermal paths 110 and 112. Thermal vias 116 may be directly under the light sources. The light sources 30 are illustrated in a ring 118 around the longitudinal axis LA.

The circuit board 30 may be made out of various materials to form a thermally-conductive substrate. The solder pads of the light sources may be connected to radial-oriented copper sectors or circular conductive elements that are over-molded into a plastic base to conduct heat away from the light sources. By removing the heat from the area of the light sources, the lifetime of the light assembly 10 may be extended. The circuit board 30 may be formed from two-sided FR4 material, heat sink material, or the like. If the board material is electrically conductive, the electrical traces may be formed on a non-conductive layer that is formed on the electrically conductive surface of the circuit board.

Figure 4C:
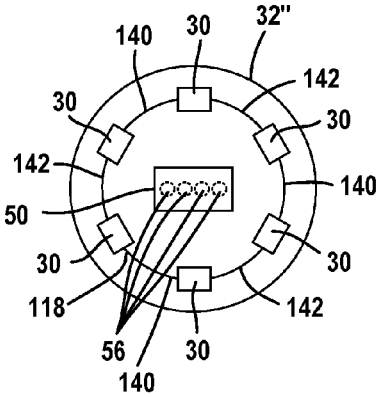
FIG. 4C is a top view of another alternate example.
Figure 4B:
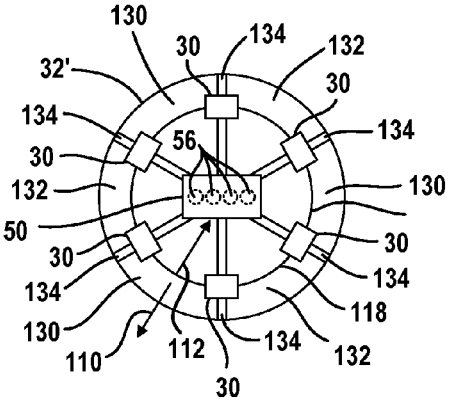
FIG. 4B is a top view of an alternate example.

Referring now to FIG. 4B, an alternative example of the circuit board 30' is illustrated. The circuit board 30' may include a plurality of circuit trace sectors 130 and 132 that are coupled to alternate voltage sources to power the light sources 30. The sectors are separated by a non-conductive gap 134. The light sources 30 may be electrically coupled to alternate sectors 130, 132. The light sources 30 may be soldered or otherwise electrically mounted to the two sectors 130, 132.

Each sector 130, 132 may be disposed on a non-conductive circuit board 30'. As mentioned above, the circuit board 30' may also be formed of a heat sink material. Should the heat sink material be electrically conductive, a non-conductive pad or layer may be placed between the sectors 130, 132 and the circuit board 30'.

Referring now to FIG. 4C, another example of a circuit board 30" is illustrated. The circuit board 30" includes the light sources 30 that are spaced apart by circuit traces 140 and 142. The circuit traces 140 and 142 may have different voltages used for activating or enabling the light sources 30. The circuit traces 140, 142 may be printed on a substrate such as a heat sink substrate. Electrical connections may be made from the control circuit board.

Figure 4D:
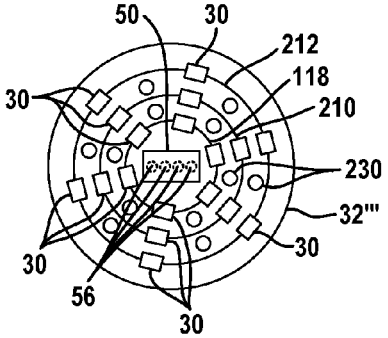
FIG. 4D is a top view of yet another alternate example of the circuit board.

Referring now to FIG. 4D, another example of the circuit board 30''' is set forth. The circuit board 30''' has a first ring 110 of light sources 30 as illustrated in FIGS. 4A-B. A second ring 210 and a third ring 262 of light sources 30 may also be used depending upon the desired output. For example, the combination of light sources 30 in the first ring may be used to provide an incandescent 40 watt equivalent light assembly. Light sources in the first ring 118 and the second ring 210 may be used to form an incandescent equivalent 60 watt light. Light sources in all three rings 118, 210 and 212 may be used to provide an equivalent 75 or 100 watt light bulb. The circuit board 30''' may also include a plurality of support holes 230 used for supporting the internal redirection element. Although six sets of support holes are illustrated, fewer support holes may be required. The support holes 230 may be used to receive support tabs of supports of the internal redirection element as will be further described below. The support holes 230 may be disposed in pairs or singularly.

Figure 5:
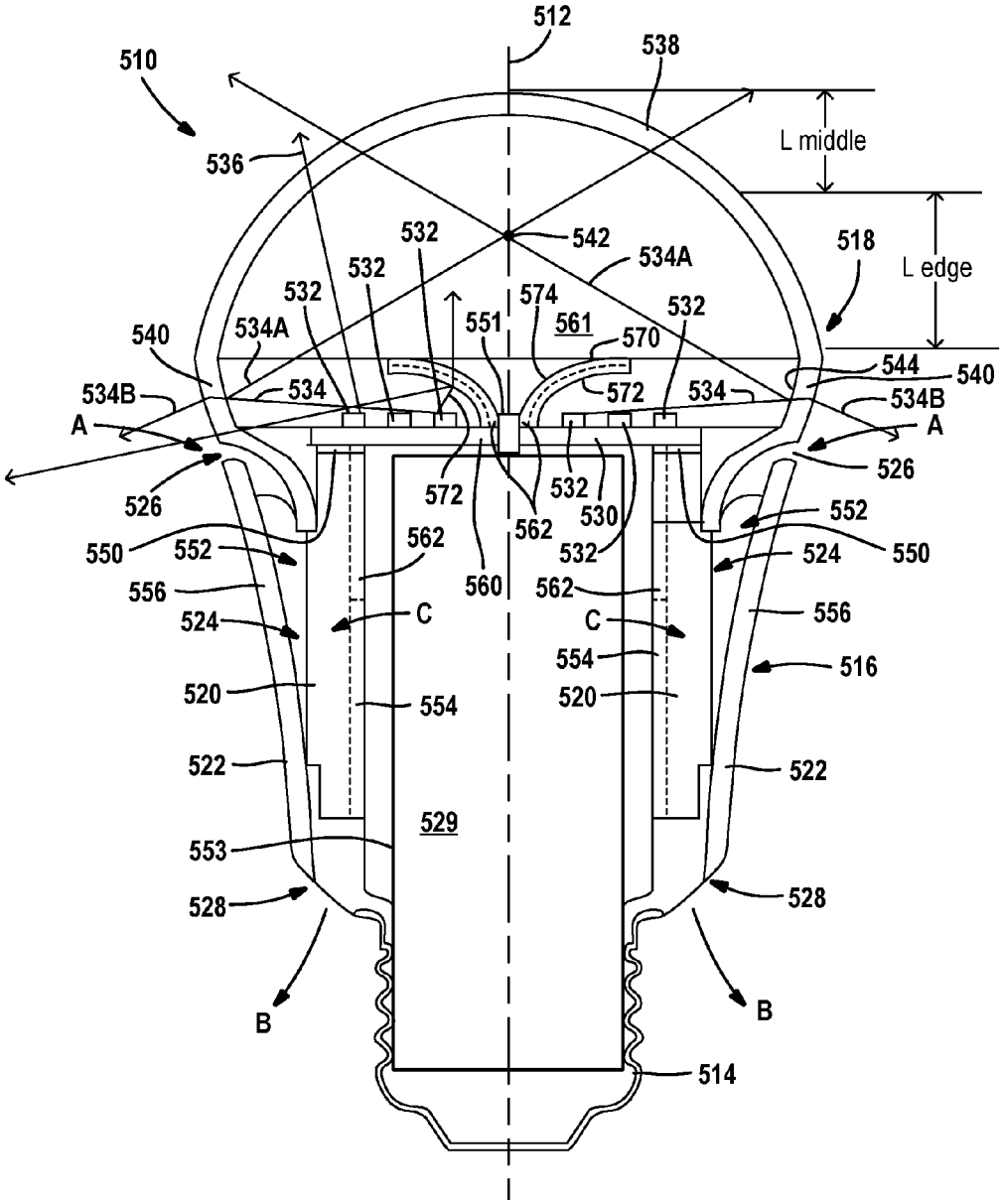
FIG. 5 is a cross sectional view of an alternate light assembly

Referring now to FIG. 5, a cross-section of a light assembly 510 is illustrated. Light assembly 510 may be rotationally symmetric around a longitudinal (or polar) axis 512. The light assembly 510 includes a lamp base 514, a housing 516, and a cover 518. The lamp base or base 514 is used for providing electricity to the bulb. The base 514 may have various shapes depending upon the application. The shapes may include a standard Edison base, or various other types of larger or smaller bases. The base 514 may be various types including screw-in, clip-in or plug-in. The base 514 may be at least partially made from metal for making electrical contact and may also be used for thermal heat conduction and dissipation. The base 514 may also be made from material not limited to ceramic, thermally conductive plastic, plastic with molded circuit connectors, or the like.

The housing 516 may have heat sinking capabilities. In the following example a heat sinking configuration is set forth. However, various configurations and heat sinks may be used. The housing 516 is adjacent to the base 514. The housing 516 may be directly adjacent to the base 514 or have an intermediate portion therebetween. The housing 516 may be formed of a metal or other heat-conductive material such a thermally conductive plastic, plastic or combinations thereof. One example of a suitable metal is aluminum. The housing 516 may be formed in various ways including stamping, extrusion, plastic molding such as over-molding or combinations thereof. Another way of forming the housing 516 includes injected-molded metals such as Zylor®. Thicksoform® molding may also be used. In one constructed example the housing 516 was formed with a first portion 520 and a second portion 522. The first portion 520 is formed of an aluminum material and the second portion 522 is formed at least partially of thermally-conductive plastic. The second portion 522 may also be formed of a portion of thermally-conductive plastic and non-thermally-conductive plastic. Thermally-conductive plastic may be used in higher temperature portions toward the lamp base while non-thermally-conductive less expensive plastic may be used in other portions of the second portion. The formation of the housing 516 will be described further below.

The housing 516 may be formed to provide an air channel 524 formed therein. The air channel 524 has a first cross-sectional area located adjacent to the cover 518 that is wider than the cross-sectional area proximate the lamp base 514. The channels 524 provide convective cooling of the housing 516 and light assembly 510. The tapered cross-sectional area provides a nozzle effect which speeds the velocity of air through the channel 524 as the channel 524 narrows. An inlet 526 to the channel 524 is provided between the second portion 522 and the cover 518. An air outlet 528 provides an outlet from the channel 524. Air from the outlet 528 is travelling at a higher speed than at the inlet 526. Arrows A indicate the direction of input air through the inlet 526 to the channels 524 and arrows B provide the outflow direction of air from the channels 524.

The plurality of channels 524 are spaced around the light assembly 510 to provide distributed cooling.

The housing 516 may define a first volume 529 within the light assembly 510. As will be described below, the first volume 529 may be used to accommodate a control circuit board or other circuitry for controlling the light-emitting diodes or other light sources therein.

The housing 516 may have various outer shapes including a hyperboloidal shape. The housing 516 may also be a free-form shape.

The housing 516 and cover 518 form an enclosure around a substrate or circuit board 530 having light sources 532. The base 514 may also be included as part of the enclosure.

The light assembly 510 includes the substrate or circuit board 530 used for supporting solid state light sources 532. The circuit board 530 may be thermally conductive and may also be made from heat sink material. Solder pads of the light sources may be thermally and/or electrically coupled to radially-oriented copper sectors or circular conductive elements over-molded onto a plastic base to assist in heat conduction. In any of the examples below, the circuit board 30 may be part of the heat sinking process.

The light sources 532 have a high lumen-per-watt output. The light sources 532 may generate the same wavelength of light or may generate different wavelengths of light. The light sources 532 may also be solid state lasers. The solid state lasers may generate collimated light. The light sources 532 may also be light-emitted diodes. A combination of different light sources generating different wavelengths may be used for obtaining a desired spectrum. Examples of suitable wavelengths include ultraviolet or blue (e.g. 450-470 nm). Multiple light sources 532 generating the same wavelengths may also be used. The light sources 532 such as light-emitting diodes generate low-angle light 534 and high-angle light 536. High-angle light 536 is directed out through the cover 518. Three light sources 532 are shown on each half of the light assembly. However the light sources 532 represent three rings of light sources 532. Only one ring may be used. However, two or more rings may be used depending on the desired total Lumen output of the light assembly.

The cover 518 may be a partial spheroid, partial ellipsoid or combinations thereof in shape. The cover 518 may share the longitudinal axis 512. In this example both a spheroidal portion 538 and a partial rotated ellipsoidal portion that may be referred to as a redirection portion 540 are formed into the cover 518. That is, the different cover portions 538, 540 may be monolithic or integrally formed. The cover 518 may be formed of a transparent or translucent material such as glass or plastic. In one example, the cover 518 is formed of polyethylene terephthalate (PET). PET has a crystalline structure that allows heat to be transferred therethrough. Heat may be transferred form the housing 516 into the cover because of the direct contact therebetween. The spherical portion 538 of the cover 518 may be designed to diffuse light and minimize backscattered light trapped within the light assembly 510. The spheroid portion 538 of the cover 518 may be coated with various materials to change the light characteristics such as wavelength or diffusion. An anti-reflective coating may also be applied to the inside of the spheroidal portion 538 of the cover 518. A self-radiating material may also be used which is pumped by the light sources 532. Thus, the light assembly 510 may be formed to have a high color rendering index and color perception in the dark.

Often times in a typical light bulb, the low-angle light is light not directed in a working direction. Low angle light is usually wasted since it is not directed out of the fixture into which the light assembly is coupled.

A portion of the low-angle light 534 may be redirected out of the cover 518 using the redirection portion 540. The redirection portion 540 may be various shapes including a partial spheroid, partial paraboloid, partial ellipsoid, or free-formed shape. The redirection portion 540 may also be shaped to direct the light from the light sources 532 to a central or common point 542 as shown by light ray 534A. The redirection portion 540 may have a coating for wavelength or energy shifting and spectral selection. Coating one or both of the cover 518 and the redirection portion may be performed. Multiple coatings may also be used. The common point 542 may be the center of the spheroid portion of the cover 518.

The redirection portion 540 may have a reflective or partially reflective coating 544 used to increase the reflectivity or change the transmittance thereof. However, certain materials upon forming may not require the coating 544. For example, some plastics, when blow-molded, provide a shiny or reflective surface such as PET. The redirection portion 540 may be formed of the naturally formed reflective surface generated when blow-molding plastic.

The cover 518 may also be formed of partially reflected material. As was described above, a portion of the light rays directed to the redirection portion 540 may also travel through the cover material and directed in a downward direction as illustrated by light ray 534B.

It should be noted that when referring to various conic sections such as an ellipsoid, paraboloid or hyperboloid only a portion or part of the conic section that is rotated around an axis may be used for a particular surface. In a similar manner, portions of a spheroid may be used.

The circuit board 530 may be in direct contact (or indirect contact through an interface layer 550) with the housing 516, and, more specifically to the first portion 520 the housing 516. The housing 516 may include a plurality of fins 552 that extend longitudinally and radially outwardly to form the channels 524. The fins 552 may be spaced apart to allow heat to be dissipated therefrom. As will be described further below, the channels 524 may be formed between an inner wall 554 of the first portion 520, an outer wall 556 of the second portion 522 and the fins 552 that may be formed of a combination of both the first portion 520 and the second portion 522 of the housing 516.

The housing 516 may thus conduct heat away from the light sources 532 of the circuit board 530 for dissipation outside the light assembly. The heat may be dissipated in the housing and the fins 552. Heat may also be transferred into the cover 518 directly from the housing conduction. In this manner heat may be transferred longitudinally by the housing 516 in two directly opposite directions.

The circuit board 530 may also include a connector 551 disposed on or through the circuit board 530 and configured to be coupled to the circuit board 553 in the same manner as the connector 50 (or connector 50') in FIGS. 1-4 above.

Openings 562 may be used for communicating air between the first volume 529 and a second volume 561 within the cover 518. Heated air that is in the cover 518 may be transmitted or communicated into the first volume 529 and through an opening 562 within the first portion 520 of the housing 516 to vent air into the channels 524. The opening 562 will be further described below.

The heated air within the cover 518 may conduct through the cover 518 and circuit board 530 to the housing as well as being communicated through the openings 562.

An internal redirection element 570 is used to redirect or partially transmit both high angle light and low angle light from the light sources 532. The internal redirection elements 570 may be formed of totally reflective material or coated with a totally reflective material. Internal means internal to the light assembly. The internal redirection element 570 may be stamped from metal or formed of a plastic material. The internal redirection element 570 also acts as a heat transfer element. A reflective coating 572 may be provided on the surface of the internal redirection element whether the material is plastic or metal. The coatings may also be reflecting in a portion of the spectrum. The material of the internal direction element may also comprise nanoparticles for wavelength shifting. Coatings may also be used for wave length shifting. A tight mesh material may also be molded within the internal redirection element 570. The mesh material 574 may act as a heat sink to direct heat toward the circuit board and into the heat sinking area below the circuit board. The mesh material 574 may also have wave length shifting details of the formation of the internal redirection element 570 which will be described further below. In general, the internal redirection element 570 is "horn" or bell shaped and is supported by the circuit board. Supporting elements (described below) are not illustrated in FIG. 2A for simplicity.

The material of the element 570 may also transmit light as well as reflect light. Controlling the transmittance and reflectance through choice of materials allows ultimate control of the output and direction of the output of the light assembly. If a material that is not light transmissive is used, holes may be formed through the element 570 to allow light therethrough. The area of the holes may vary depending on the desired light output characteristics. For example, 80% of the light may be reflected while 20% is transmitted through element 570.

Figure 6A:
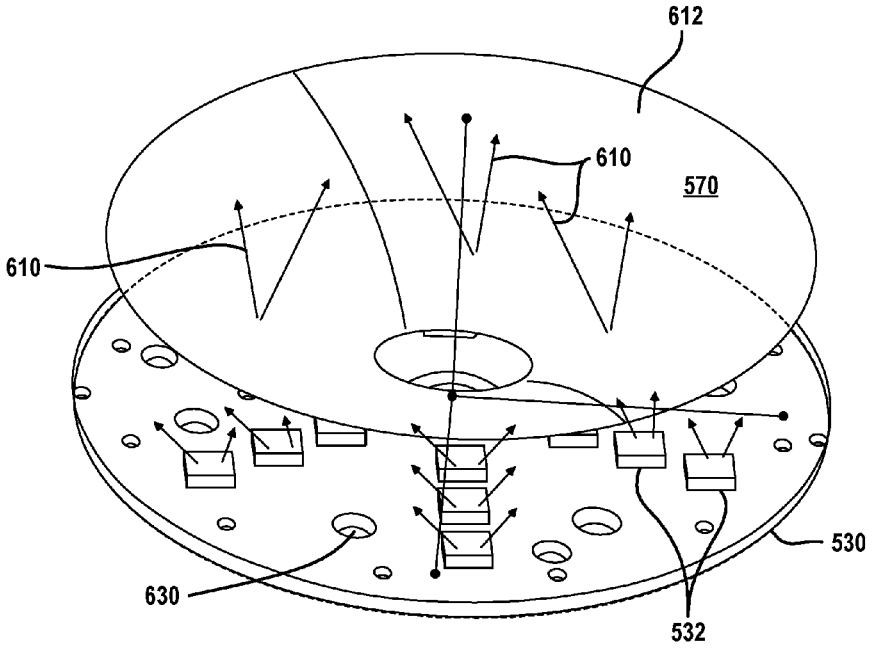
FIG. 6A is perspective view of the light redirection element of FIG. 5.

Referring now to FIG. 6A, a perspective view of the internal redirection element 570 relative to the circuit board 530 is illustrated. In this example, the internal redirection elements 570 are at least partially translucent or transparent. Light rays 610 are from the light sources 532 and are shown at least partially transmitting through the internal redirection element 570. The upper surface 612 of the internal redirection element 570 may also be curved in a horn or bell shape. The support described below is not illustrated filling or coupled to the support holes 630 for simplicity.

Figure 6B:
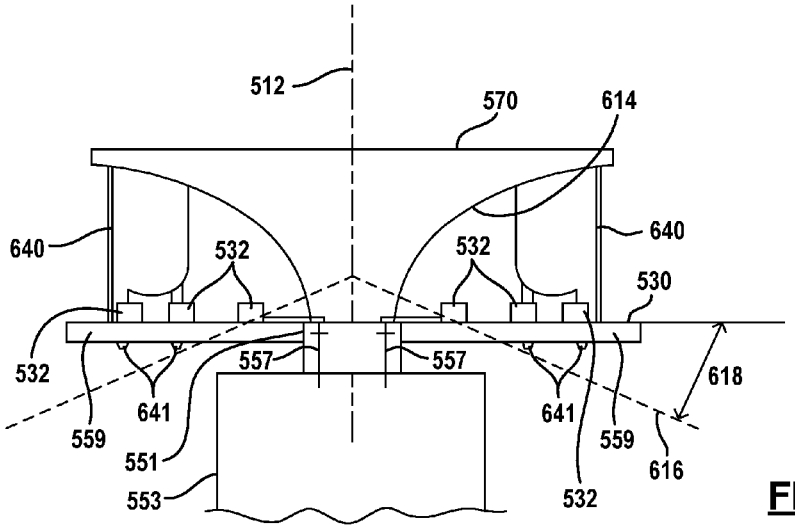
FIG. 6B is cross-sectional view of an alternate connector used in the light assembly of FIG. 5.

Referring now to FIG. 6B, the internal redirection element 570 relative to the longitudinal axis 512 is set forth. In this example, the at least partially reflecting or undersurface 614 of the internal redirection element is illustrated. The curve associated with the surface 614 may be various curvilinear shapes. These shapes may include conic sections including, but not limited, to paraboloids, hyperboles, spheres or the like. In the present example, the surface 614 is a paraboloid in cross-section. The paraboloid has an axis 616 that has been shifted about its focal line by an angle 618. In this example, the focal line coincides with the row of LEDs 532 closest to the longitudinal axis of the light assembly axis 512. Light reflecting from the surface 614 will thus reflect parallel to the shifted axis 616 and thus is shifted from the lateral direction of the circuit board 530. The shape of the surface 614 may be formed according to the formulas set forth below:

$$z = \frac{cr^2}{1 + \sqrt{1 - (1+k)c^2r^2}} + \sum_{i=1}^{n} a_i r^{2i}$$

c=base curvature at vertex
k=conic constant

| Conic Constant | Surface Type |
|---|---|
| k = 0 | spherical |
| k = −1 | Paraboloid |
| k =< −1 | Hyperboloid |
| −1 < k < 0 | Ellipsoid |

As is illustrated, three concentric circled of light emitting diodes are shown. Each of the concentric circles or light emitting diodes 532 may represent a single string of light emitting diodes. The strings of light emitting diodes will be described further below. The strings of light emitting diodes 532 may be connected or coupled to the circuit board 553 through a connector 551. Conductors 555 of the circuit board 553 extend and electrically contact the conductors 557 of the connector 551. The conductors 557, 555 and the circuit traces 559 of the circuit board 553 are all in electrical contact. Of course, different conductors on different portions of the circuit board may be in contact with different conductors or terminals within the connector.

Figure 7:
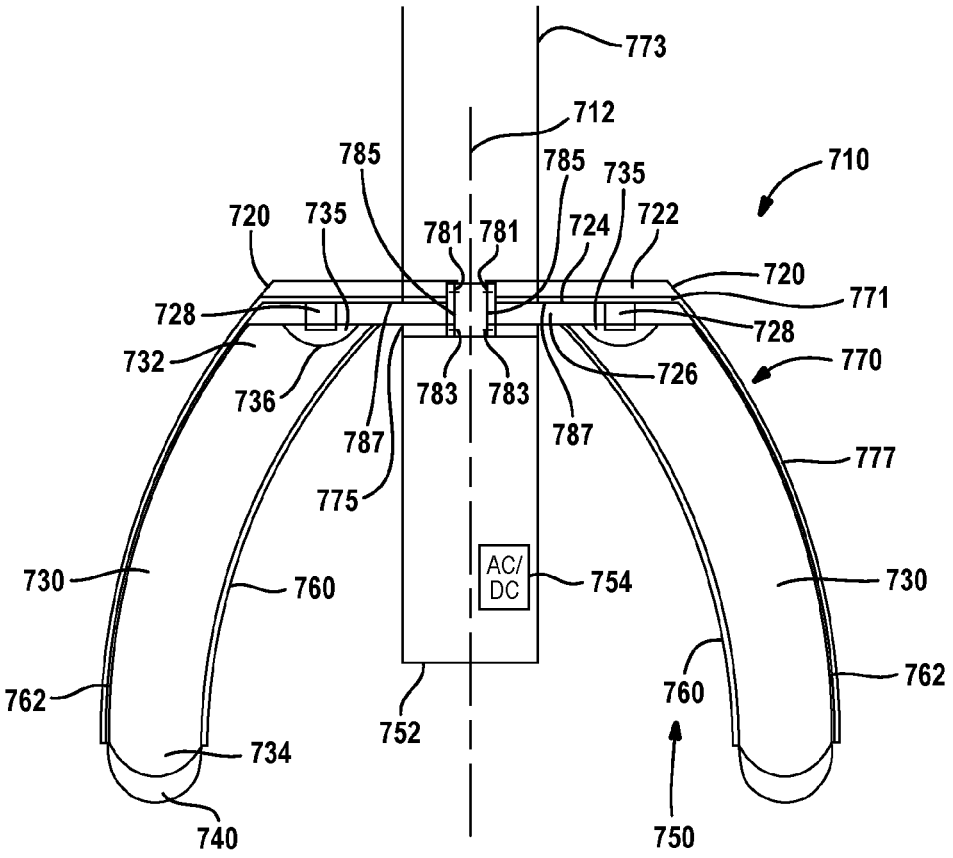
FIG. 7 is a cross-sectional view of another example of a light assembly according to the present disclosure.

Referring now to FIG. 7, another example is illustrated. A cross-section of a light assembly 710 is illustrated. Light assembly 710 includes a longitudinal axis 712. The light assembly 710 includes a light source circuit board 720 that has a plurality of layers thereon. In this example, the light source circuit board includes an insulating layer 722 (heat conductive, not electrically conductive), an electrically and thereby conductive layer 724, and another electrically insulating layer 726. The light source circuit board 720 may be formed of conventional material such as FR4 and metallic traces as the conducting layer 724. A multi-layer circuit board may also be used. The light source circuit board 720 may also be a laser-cut circuit board that has the circuit traces, solder pads or other conductors laser-cut thereon. Prior to cutting the conductors are over-molded with the insulating layer or layers 724, 726. The circuit board 720 may have a conductive layer 724 formed of a metal such as aluminum or stainless steel with an oxide layer or anodized layer as the non-electrically.

The metallic or conducting layer 724 may have a plurality of light sources 728 disposed thereon. The light sources 728 are solid state light sources such as lasers or light-emitting diodes. The lasers may be light-emitting diode-based. Thus, the term light-emitting diode can refer to both a laser and conventional light-emitting diode. The conducting layer 722 may have different sections that have various polarities so that a positive and negative potential difference may be generated to illuminate the light-emitting diodes. The circuit board 720 may have various shapes including a round shape. The circuit board 720 may have the light-emitting diodes or other light sources 728 disposed in a ring around the axis 712.

Each light-emitting diode 728 may have a light pipe 730 associated therewith. The light pipes 730 are elongated and extend in a direction generally axially from the light sources 728. In the present example, the light pipes 730 also extend in a radially outward direction from the longitudinal axis of symmetry as well. The light pipes 730 in this example are curved. Each light pipe 730 has a first end 732 adjacent to the light source 728 and a second end 734 opposite the light source 728. The first end 732 may include a cavity 735 and collimating optic 736 to collimate the light from the light source 728 into the light pipe 730. The cavity 735 encloses the light source 728. Of course, more than one light source may be enclosed within the cavity. One example of a suitable collimating optic 736 is a Fresnel lens. As will be further described below, total internal reflection or near total internal reflection may be used to reflect the light down the light pipe and out the second end 734.

The second end 734 may have a beam-forming optic 740 disposed thereon. The beam-forming optic 740 may be integrally formed with the second end 734 of the light pipe 730. A separate component may also house the beam-forming optic or optics. The beam-forming optic 740 may have various shapes to direct the light in a desired direction or pattern. Narrow beam-forming with little divergence may be desirable. Also, wide-spreading flood-type beam divergence may also be desired. The type of beam divergence or beam pattern depends upon the specific use for the light. Thus, various beam-forming optics may be used.

The plurality of light pipes 730 may be disposed in a circular pattern corresponding to the ring of the light sources 728. The light pipes 730 may form a cavity 750 therebetween. That is, the cavity 750 may be formed between opposite light pipes 730 to form a void therebetween. The cavity is within an inner surface of the light assembly. The cavity 750 is the volume between the light pipes 730.

The cavity 750 may have a driver circuit board 752 disposed therein. The driver circuit board 752 may be electrically and mechanically coupled to the light source circuit board 720. The driver circuit board 752 may have pins 783 extending therefrom. The pins 783 may be used to power the driver circuit board 752. Electrical connections between the driver circuit board 750 and the circuit board 720 may also be formed so that the light sources 728 are powered thereby. The driver circuit board 752 may include an AC to DC circuit 754 for powering the light sources 728. Of course, other circuits may be included such as dimmer circuits, timer circuits and sensor circuits.

The light pipes 730 may also include a coating 760, 762 thereon. The coating 760, 762 may be applied to the outer surface of the light pipe 730 to allow the light therein to internally reflect more efficiently. The coating 760, 762 may be a reflective coating. The coating 760, 762 may also be an energy-conversion (wavelength-converting) coating applied thereto. The coating 760, 762 allows the wavelength of the light travelling down the light pipe to convert from one wavelength to another wavelength. The amount of conversion may be regulated depending upon the type of coating. The coating 760, 762 may be a painted material or a polymer-type material applied to the outer surface of the light pipe.

The conductive layer 724 of the circuit board 720 may also extend outward from the circuit board 720 and form a heat sink 770 adjacent to the light pipes 730 on an outer surface of the light assembly 710. The heat sink 770 may be formed fingers of the same material as the conducting layer 724. As is illustrated, the conducting layer 724 extends into the heat sink 770. However, different structures may be provided for the conducting layer 724 and the heat sink 770 that are coupled together during manufacture. The heat sink 770 draws heat from the light sources 728 in a radial direction and in an axial direction away from the light sources 728. The heat sink 770 may be referred to as a plurality of thermal vanes 772.

In this example, two circuit boards may be attached to the connector 771. A first circuit board 773 may be coupled to provide power to the circuit board from the base of the light assembly. The first circuit board 773 may be a pass-through circuit board that only includes conductors or may be one of the various types of circuit boards illustrated in FIGS. 3A-3E with electrical circuits. However, a second circuit board 775 may also include circuitry which is in communication with the connector 771. In particular, the conductor 781 of the circuit board 773 is in communication with the conductor 783 of the circuit board 775. Conductors of the connector 771 may be in communication with the conductors 787 of the circuit board 720. As mentioned above, various types of connections including sockets and pins may be implemented to form the interconnections. Various types of circuit boards 775 and the circuitry thereon may be implemented. For example, additional circuitry such as dimmer circuits, remote controls and the like may be implemented in the circuit board 775. Of course, the circuitry illustrated in FIGS. 3A-3E may be incorporated into the circuit board 775.

Figure 8:
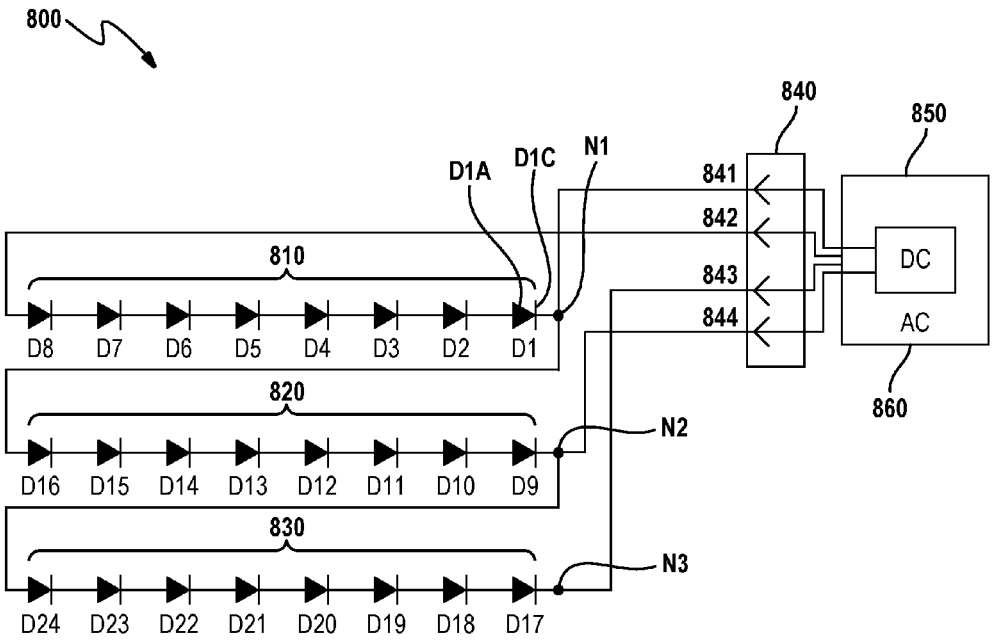
FIG. 8 is a schematic view of a light engine according to the present disclosure.

Referring now to FIG. 8, a first plurality of diodes D1, D2, D3, D4, D5, D6, D7 and D8. Each of the first plurality of diodes 810 are connected in series and may be referred to as a string. A cathode D1C is in communication with a first node N1. A first anode D1 is coupled to the cathode of the adjacent diode D2 in the series coupling. Each of the diodes are coupled in the same manner with adjacent anodes connected to adjacent cathodes. For simplicity, each of the cathodes and diodes of the diodes D2 through D8 have not been individually labelled.

A second plurality of diodes D9 through D16 are also coupled in series. The cathode of diode D9 is electrically coupled to a second node N2. The anode of diode D16 is electrically coupled to node N1.

A third plurality of diodes 830 is illustrated. The diodes D17 though D24 are coupled in series. The anode of diode D24 is in electrical communication with node N2. Each of the plurality of diodes have a cathode and an anode N that refers to the first cathode and the last anode of each of the series combinations. A connector 840 has a plurality of terminals coupled thereto. In this example, four terminals 841, 842, 843, and 844 are disposed within the connector 840. The connector 840 may correspond to the connectors illustrated in FIGS. 1-7. The connector 840 may be disposed on the surface of a circuit board or may be disposed within a circuit board. The terminal 841 may be referred to as an alternating current terminal. The terminal 844 may also be referred to as an alternate current terminal. The terminal 842 may be referred to as a dual alternating current direct current terminal. The terminal 843 may also be referred to as a dual alternating current-direct current terminal. The dual alternating current-direct current terminals are capable of being connected to both AC or DC power sources depending on the configuration of the power source. This allows fewer permutations of the circuitry and less cost. The terminal 841 is in electrical communication with node N1 and thus the cathode of diode D1. The terminal 841 is also in electrical communication with the anode of diode D16 in the second plurality of diodes 820.

The terminal 842 is in electrical communication with the anode D8 of the first plurality of diodes 810.

The terminal 843 is in electrical communication with the cathode of the diode D17 of the third plurality of diodes 830 at node N3. The terminal 844 is in electrical communication with node N2 which is in electrical communication with the cathode of D9 and the anode of diode D24.

By providing at least three strings of LEDs, a standardized light engine is set forth. Collimating optics and omnidirectional optics may be coupled with the diodes to provide a light output. The flexibility of the systems 841-844 to be coupled to DC or AC sources. When direct current applications are desired, the terminals 842 and 843 are coupled to positive and negative DC source 850. However, if an AC source is provided, terminals 841-844 are coupled to the AC source 860. Either one source or the other source may be implemented. However, in certain implementations, both an AC source and DC source may be used in combination. An AC driver 860 may be used to power the LEDs via a multi-tap connector 840 that allows sub-strings to be enabled during portions of the AC cycle, When the DC source 850 is used, sub-strings or the entire string may be controlled. In a DC format, the strings of diodes 810, 820 and 830 are controlled in series. Of course, an integrated circuit such as a system on chip may be used for the DC source 850 or the AC source 860.

In operation, the DC source provides DC power through terminals 842 and 843. As can be seen, terminals 841 and 844 would not be used in a DC configuration. This allows each of the plurality of diodes to act in series. That is, the first plurality of diodes 810, the second plurality of diodes 820 and the third plurality of diodes 830 are coupled in series in a DC manner. When the AC power source 860 is implemented, the wave forms may be controlled in various manners to provide a desired output. Essentially, as the wave form increase, the diodes will be activated in series for each of the series combination of the plurality of diodes 810, 820 and 830. When alternating current is provided, the wave forms may be staggered to provide the desired output and the desired timing of the illumination of each of the diodes, The light engine 800 may be incorporated onto a single circuit board or may be included in a discrete circuit or integrated system on a chip (SOC). If more strings of diodes are desired, more terminals may be provided. Typically, one more terminal is provided than the number of pluralities of diodes. In this example, four terminals provide power to three strings of diodes. If eight strings of diodes were provided, nine terminals would be provided.

Figure 9:
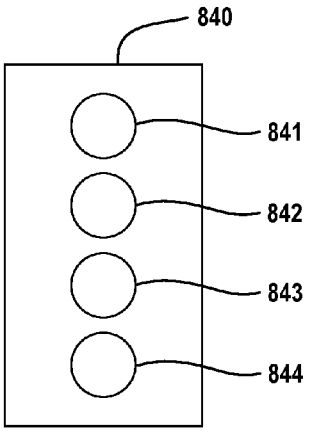
FIG. 9 is a top view of the connector of FIG. 8.

Referring now to FIG. 9, a top view of the connector 840 is illustrated. In this example, the terminals 841, 842, 843 and 844 are circular. However, various shapes and sizes of terminals may be provided. Each of the terminals may also not be shaped the same.

Figure 10:
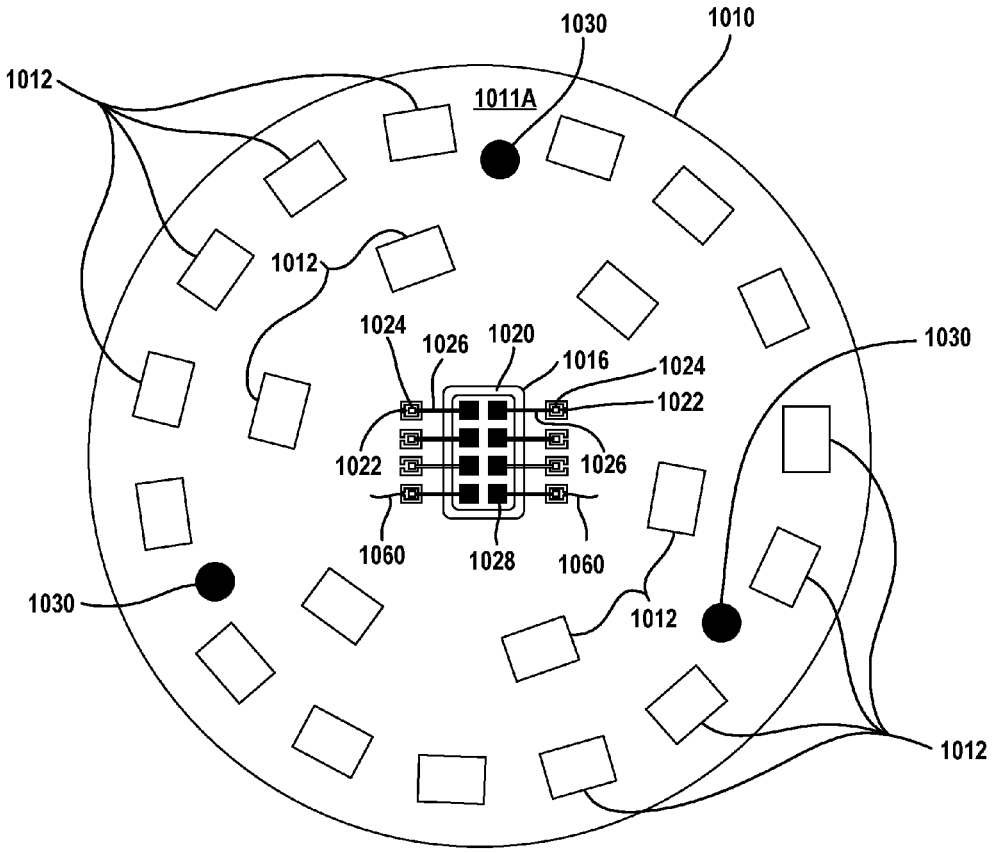
FIG. 10 is a top side view of a metal core printed circuit board according to another example.

Referring now to FIG. 10, a circuit board 1010 is illustrated having a plurality of light sources 1012. The light sources 1012 may be arranged in a regular pattern. The pattern and the number of light sources 1012 may vary depending on the particular application. As mentioned above, the light sources 1012 may be one of a variety of different light sources including LEDs, lasers and the like.

Figure 11:
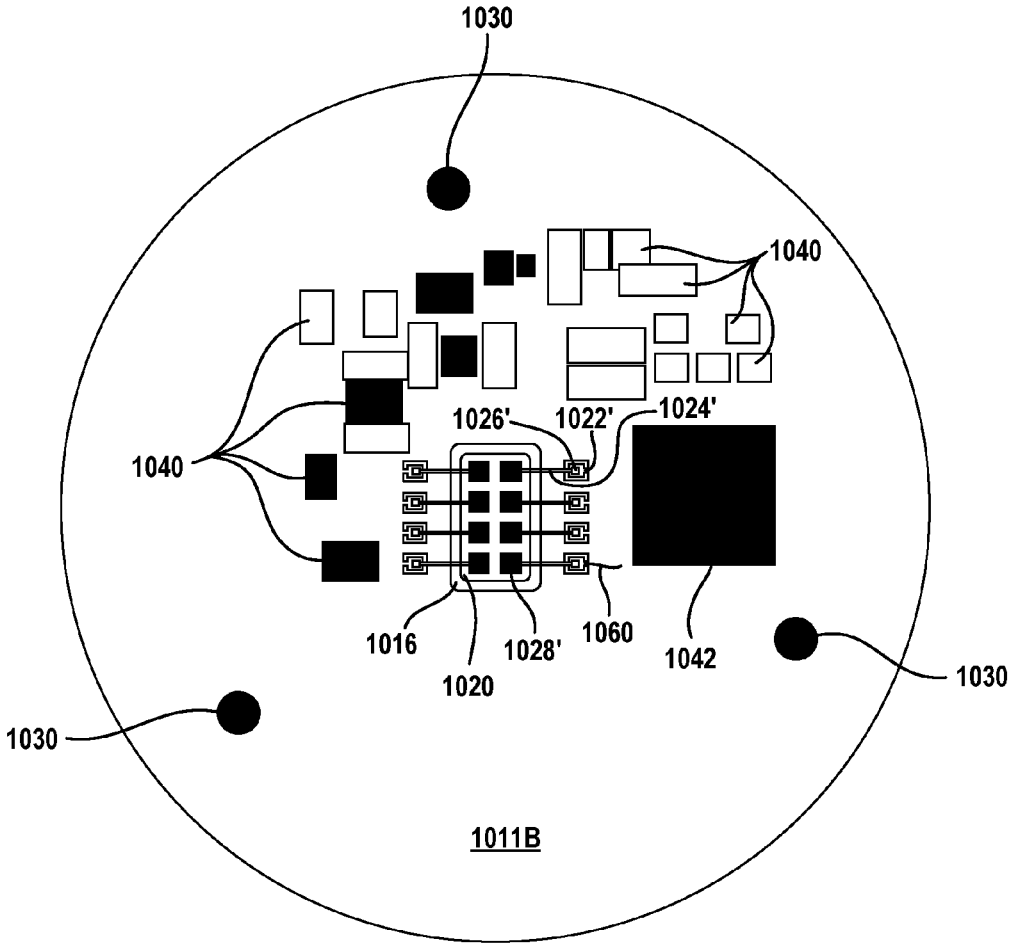
FIG. 11 is a bottom side view of metal core printed circuit board of FIG. 10.
Figure 14:
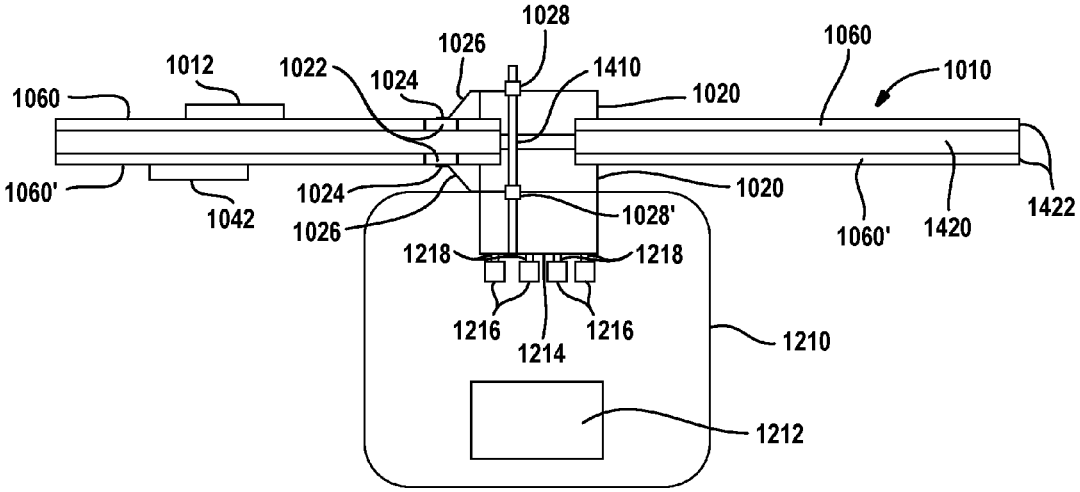
FIG. 14 is a cross-sectional view of the metal core printed circuit board relative to another circuit board.

The circuit board 1010 may be a metal core printed circuit board (MCPCB). As will be described further below, the metal core printed circuit board may include a top surface 1011A with a plurality of conductors 1060 and, as illustrated in FIG. 11, a bottom surface 1011B also with a plurality of conductors 1060'. The circuit board 1010 may also include a dielectric layer as will be further described below in FIG. 14.

The circuit board 1010 may include an opening 1016 that extends therethrough. The opening 1016 is sized to receive a connector 1020 on portions of the connector 1020. The connector 1020 is disposed through the circuit board 1010.

The circuit board 1010 may include a plurality of solder pad 1022 onto which solder pads 1024 of the connector 1020 are electrically coupled. Leads 1026 may couple the solder pads 1024 to a terminal 1028 within the connector 1020. In the present example, eight terminals 1028 coupled to eight solder pads 1024 and eight leads 1026 are set forth. In this example, two rows of four terminals 1028 are provided. However, multiple shapes and numbers of terminals 1028 may be included in the system.

The circuit board 1010 may also include through holes 1030. The through holes 1030 may be used as an interface for grabbing by an automated placement machine used during assembly of the light assembly.

Referring now to FIG. 11, the second side 1011B of the circuit board 1010 is set forth. In this example, a plurality of surface mounted devices 1040 are illustrated. The surface mount devices 1040 may each include a corresponding solder pad and conductors. The second side 1011B of the circuit board 1010 may include a driver circuit 1042. The driver circuit 1042 may be an AC driver, a DC driver or a combination thereof. The driver 1042 may also be surface mounted to the circuit board 1010.

The underside of the connector 1020 is also illustrated. The connector 1020 may also include terminals 1028', solder pad 1022', solder pad 1024' and leads 1026'. The solder pads 1024' may be surface mount surface pads that are connected electrically to the solder pads 1022'.

Figure 12:
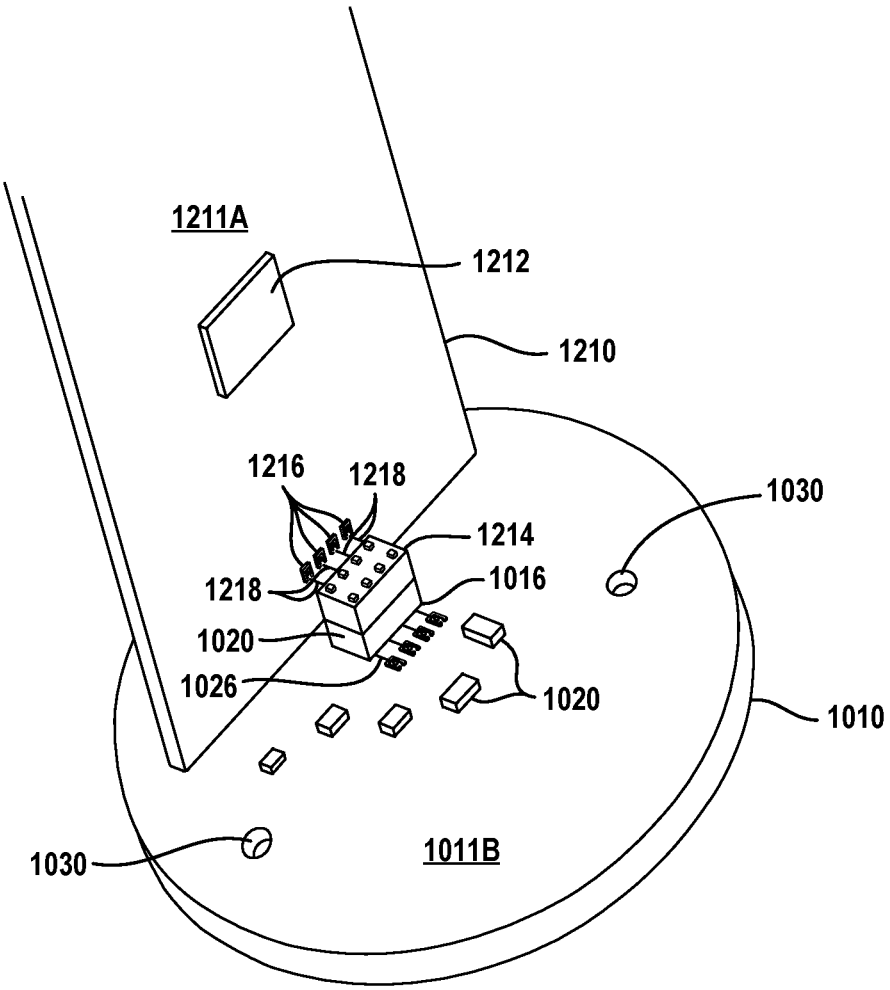
FIG. 12 is a perspective view of a second circuit board coupled to the metal core printed circuit board.

Referring now to FIG. 12, a circuit board 1210 having a front side 1211B having various components 1212 including a connector 1214 are set forth. The circuit board 1210 may be in a plane perpendicular to the circuit board 1010. The connector 1214 may be surface mounted to the circuit board 1210 in a similar manner to that set forth above with respect to FIGS. 10 and 11 using solder pads 1216 and leads 1218. The connector 1214 interfaces with connector 1020. The connector 1214 may have pins (illustrated below) that extend therefrom as will be further described below. The pins or conductors may contact the terminals 1028 and 1028', illustrated in FIGS. 10 and 11. The components 1212 of the circuit board 1010 may include various types of electrical components including control circuits used for dimmers, the internet of things (IOT) and various other types of controls for a light assembly.

Figure 13:
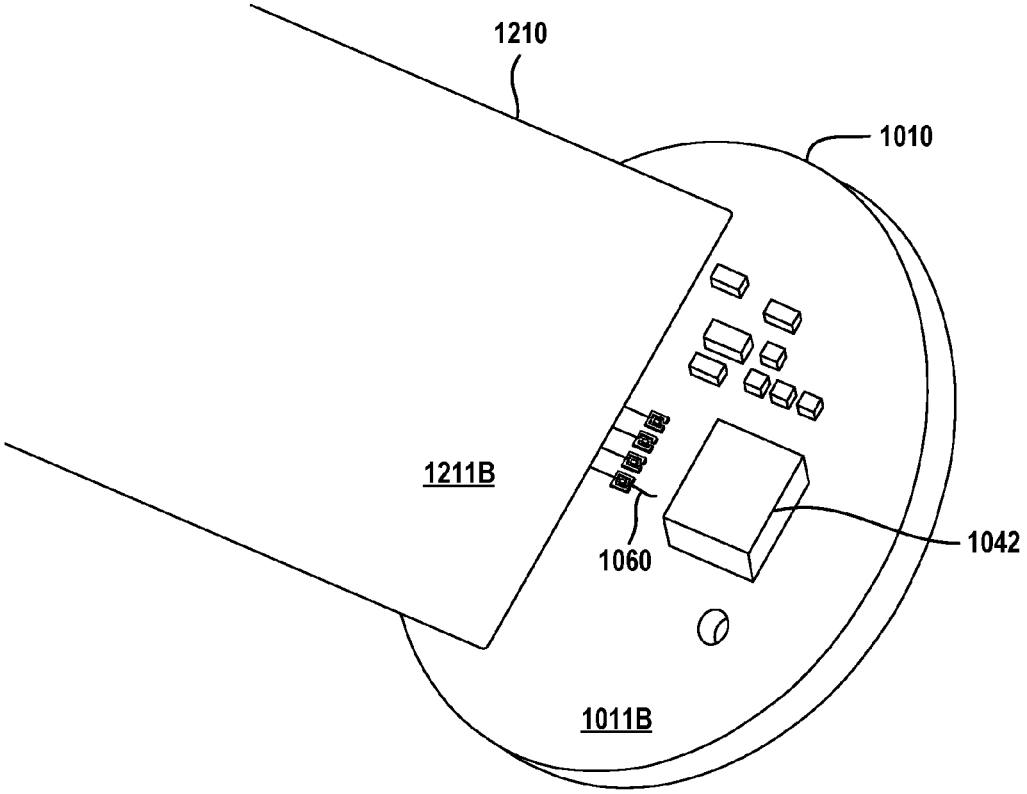
FIG. 13 is a second perspective view of the circuit board coupled to the metal core printed circuit board.

Referring now to FIG. 13, the back side 1211B of the circuit board 1210 is illustrated. In this example, the driver 1042 is illustrated on the second side 1011B of the circuit board 1010. It should be noted that various numbers of conductors 1060 may be included on the circuit board 1010, only one of which is shown to reduce the complexity of the figure. A pin 1410 that is electrically coupled to other components on the connection board 1210 is set forth. The pin 1410 may be electrically coupled to various electrical components or provide a pass-through circuit lead as illustrated in a similar manner to FIG. 3*d*. Although only one pin 1410 is illustrated, various numbers of pins for each of the terminals 1028 of the connector 1020 may be provided.

The circuit board 1010 includes the first side conductor 1060, the second side conductor 1060' and a core 1420. The core 1420 may be made of metal or a dielectric. The core 1420 may be separated from the conductors 1060, 1060' by a thin dielectric layer 1422 disposed between the conductors 1060 or 1060' and the core 1420.

The foregoing description of the examples has been provided for purposes of illustration and description. It is not intended to be exhaustive or to limit the disclosure. Individual elements or features of a particular example are generally not limited to that particular example, but, where applicable, are interchangeable and can be used in a selected example, even if not specifically shown or described. The same may also be varied in many ways. Such variations are not to be regarded as a departure from the disclosure, and all such modifications are intended to be included within the scope of the disclosure.

What is claimed is:

1. A light engine:

a first plurality of diodes coupled in series, said first plurality of diodes comprising a first anode end and a first cathode end;

a second plurality of diodes coupled in series, said second plurality of diodes comprising a second anode end and a second cathode end;

a first terminal electrically coupled to said first cathode end and said second anode end to form a first node;

a second terminal coupled to said first anode end;

a third plurality of diodes coupled in series, said second plurality of diodes comprising a third anode end and a third cathode end;

a third terminal coupled to said third cathode end; and a fourth terminal electrically coupled to said second cathode end and said third anode end to form a first node;

wherein the first terminal comprises a first alternating current terminal, the second terminal comprises a first dual alternating current direct current terminal, the third terminal comprises a second dual alternating current direct current terminal and the fourth terminal comprises a second alternating current terminal.

2. A light engine:

a first plurality of diodes coupled in series, said first plurality of diodes comprising a first anode end and a first cathode end;

a second plurality of diodes coupled in series, said second plurality of diodes comprising a second anode end and a second cathode end;

a first terminal electrically coupled to said first cathode end and said second anode end to form a first node;

a second terminal coupled to said first anode end;

a third plurality of diodes coupled in series, said second plurality of diodes comprising a third anode end and a third cathode end;

a third terminal coupled to said third cathode end; and a fourth terminal electrically coupled to said second cathode end and said third anode end to form a first node:

wherein the first terminal, the second terminal, the third terminal and the fourth terminal are disposed in a connector;

wherein the connector and the first plurality of diodes, the second plurality of diodes and the third plurality of diodes are disposed on opposite sides of a first circuit board.

3. The light engine as recited in claim 2 wherein the connector and the first plurality of diodes, the second plurality of diodes and the third plurality of diodes are disposed on a first circuit board.

4. The light engine as recited in claim 3 wherein the connector is disposed through the first circuit board.

5. The light engine as recited in claim 3 wherein the connector is disposed on a surface of the first circuit board.

6. A light assembly:

a light engine circuit board comprising;

a first plurality of diodes coupled in series, said first plurality of diodes comprising a first anode end and a first cathode end;

a second plurality of diodes coupled in series, said second plurality of diodes comprising a second anode end and a second cathode end;

a first terminal electrically coupled to said first cathode end and said second anode end to form a first node;

a second terminal coupled to said first anode end;

a third plurality of diodes coupled in series, said second plurality of diodes comprising a third anode end and a third cathode end;

a third terminal coupled to said third cathode end; and a fourth terminal electrically coupled to said second cathode end and said third anode end to form a first node;

a first connector disposed on the light engine circuit board;

a second circuit board comprising at least a fifth terminal electrically coupled to one of the first terminal, second terminal, a third terminal or a fourth terminal and a sixth terminal coupled to another of the first terminal, second terminal, a third terminal or a fourth terminal;

said second circuit board coupling electricity to the light engine circuit board; and a third circuit board comprising a driver circuit coupled to the first connector.

7. The light assembly as recited in claim 6 wherein second circuit board coupling direct current electricity to the light engine circuit board.

8. The light assembly as recited in claim 6 wherein second circuit board coupling alternating current electricity to the light engine circuit board.

9. The light assembly as recited in claim 6 wherein first circuit board and the second circuit board are disposed in perpendicular planes.

10. The light assembly as recited in claim 6 wherein the light engine is coupled to a first side of the light engine circuit board and a driver circuit is coupled to a second side of the light engine circuit board.

* * * * *